US005560161A

United States Patent [19]

Lou

[11] Patent Number: 5,560,161

[45] Date of Patent: Oct. 1, 1996

[54] ACTIVELY TUNED LIQUID DAMPER

[76] Inventor: Jack Y. K. Lou, 1004 Rose Cir., College Station, Tex. 77840

[21] Appl. No.: 276,050

[22] Filed: Jul. 15, 1994

[51] Int. Cl.[6] ..... E04H 9/02

[52] U.S. Cl. ..... 52/167.2; 188/378

[58] Field of Search ..... 52/167.1, 167.2; 188/378, 379, 380

[56] References Cited

U.S. PATENT DOCUMENTS

| | | | |
|---|---|---|---|
| 4,783,937 | 11/1988 | Sato | 52/167.2 X |
| 4,894,965 | 1/1990 | Sato | 52/167.2 |
| 4,922,671 | 5/1990 | Sato | 52/167.2 |
| 4,924,639 | 5/1990 | Sato et al. | 52/167.2 |
| 4,951,441 | 8/1990 | Noji et al. | 52/167.2 X |
| 4,953,330 | 9/1990 | Noji et al. | 52/167.2 |
| 4,972,636 | 11/1990 | Noji et al. | 52/167.2 |
| 4,987,710 | 1/1991 | Noji et al. | 52/167.2 |
| 4,987,711 | 1/1991 | Noji et al. | 52/167.2 |

FOREIGN PATENT DOCUMENTS

| | | | |
|---|---|---|---|
| 40418998 | 7/1992 | Japan | 52/167.2 |

OTHER PUBLICATIONS

Chen, W., Kehtarnavaz, N., Spencer, T. W., "An Efficient Recursive Algorithm for Time–Varying Fourier Transform," *IEEE Trans. on Signal Processing*, vol. 41, No. 7, Jul. 1993.

Chung, L. L., Reinhorn, A. M., Soong, T. T., "Experiments on Active Control of Seismic Structures," *Journal of Engineering Mechanics*, vol. 114, No. 2, 1988, pp. 241–255.

Fujimo, Y., Sun, L. M., "Vibration Control by Multiple Tuned Liquid Damper (MTLDs)," *Journal of Engineering*, vol. 119, No. 12, 1993, pp. 93–106.

Fujimo, Y., Sun, L. M., Pacheco, B. M., Chaiseri, P., "Tuned Liquid Damper for Suppressing Horizontal Motion of Structures," *Journal of Engineering Mechanics*, Col. 118, No. 110, 1992, pp. 2017–2030.

Hamlin, N. A., Lou. Y. K., Maclean, W. M., Seibold, F. Chandras, L. M., "Liquid Sloshing in Slack Ship Tanks–Theory, Observations and Experiments, " *Trans, Society of Naval Architects and Marine Engineers*, 1986, pp. 159–196.

Kobori, T., "Active Seismic Response Control –State–of–the–art report", *Proc. of Ninth World Conference on Earthquake Engineering*, Aug. 1988, pp. VIII 435–446.

Lou, Y. K., Wu, M. C., Lee, C. K., "Development of Design Guidelines for Liquid Sloshing Loads," Report No. COE 276, Ocean Engineering Program, Texas A&M University, 1984.

Lou, Y. K., Wu, M. C. and Lee, C. K., "Further Studies on Liquid Sloshing," Report No. MARD–760–85009, Maritime Administration, 1985.

Lou, Y. K., Choi, H. S., "Liquid Sloshing Loads Under Random Excitation, " Report No. MA–RD–840–88036, Maritime Administration.

Miller, R. K., Masri, S. F., Dehghanyar, T. J., Caughey, T. K., "Active Vibration Control of Large Civil Structures," *Journal of Engineering Mechanics*, vol. 114, No. 9, 1988, pp. 1542–1570.

Modi, V. J., Welt, F., "Vibration Control Using Nutation Dampers," *Proc., International Conf. on Flow Induced Vibrations*, May 1987, England.

Sayar, B. A., Baumgarten, J. R., "Linear and Nonlinear Analysis of Fluid Slosh Dampers," *AIAA Journal*, Nov. 1982, pp. 1534–1538.

(List continued on next page.)

*Primary Examiner*—Carl D. Friedman
*Assistant Examiner*—Yvonne Horton-Richardson
*Attorney, Agent, or Firm*—Rosenblatt & Redano, P.C.

[57] ABSTRACT

The invention concerns the use of actively tuned liquid dampers to quench vibrations in large civil structures. Such vibrations may be induced by earthquakes or high winds. The effective length of the liquid damper tank determines the natural frequency of the liquid, and thus the effectiveness of the damper at particular excitation frequencies. The liquid damper is tuned by rotating baffles to regulate the effective length of the damper tank.

16 Claims, 1 Drawing Sheet

OTHER PUBLICATIONS

Shimizu Corporation, "Tuned Sloshing Damper, Super Sloshing Damper," *Institute of Technology Report*, Aug. 1987.

Soong, T. T., "State–of–the–Art of Structual Control in U.S.A., " *Proc, U.S. National Workshop on Structual Control Research*, 1990, pp. 48–65.

Sun, L. M., Fujino, Y., Pacheco, B. M., Isobe, M., "Nonlinear waves and Dynamic Pressures in Rectangular Tuned Liquid Damper –Simulation and Experimental Verification," *Structual Engineering/Earthquake Engineering*, vol. 6, No. 2, 1989, pp. 251s–262s.

Wakahara, T. Ohyama, T., Fujii, K., "Suppression of Wind–Induced Vibration of a Tall Building Using Tuned Liquid Damper," *International Conference on Wind*, 1991.

Watabe, M., Mita, A., "Emerging Needs for Damping Augmenting Systems Applicable to Super tall Buildings," Presented at the International Workshop of Structual Control, Honolulu, Hawaii, Sep. 1993.

ACTIVELY TUNED LIQUID DAMPER

FIELD OF THE INVENTION

The invention concerns actively tuned liquid dampers for use in reducing the vibrations of large civil structures, such as tall buildings and suspension bridges, which are excited by high winds or earthquakes.

BACKGROUND OF THE INVENTION

Large civil structures are frequently exposed to severe dynamic loading from several sources including earthquakes and high winds. During high winds, the sway motion at the top of a tall building and the vertical deflection on long suspension bridges may reach tens of feet. Therefore, one of the most important problems facing civil engineers today is to find ways to reduce the motions of a large civil structure to ensure structural integrity and human comfort.

Until recently, large civil structures have been built as passive structures. The external dynamic loads were resisted solely by the mass and stiffness of the structure. However, as the structures have become longer, taller and more flexible, and the demand for safety has increased, the need for building structures with some degree of adaptability to external forces has been recognized.

In the last two decades, structural control concepts have received considerable attention for the design of large civil structures. Several tall buildings have been constructed with various types of movement control devices installed. Most of these movement control devices are passive devices. The most commonly used passive systems are base isolation, viscoelastic dampers, and tuned mass dampers.

Viscoelastic dampers are installed in the World Trade Center buildings in New York, in the Columbia Center building, and a new building at 2 Union Square; in Seattle. Tuned mass dampers are installed in the Centrepoint Tower in Sidney, Australia, the Canadian National Tower in Toronto, the John Hancock Tower in Boston, and the Citicorp Center in New York. Tuned liquid dampers were recently installed in several buildings in Japan, including the Yokohama Marine Tower, the Shin Yokohama Prince Hotel, and a new control tower at the Narita Airport. Model test results indicate that tuned liquid dampers are effective in reducing wind-induced vibrations.

Liquid dampers have long been used to reduce the roll motion of ships. A typical antirolling tank will have an H configuration when viewed from above. The horizontal channel which connects the two wing tanks is designed to control the speed of the flow. Some of the antirolling tanks have also incorporated semi-active control devices to improve their effectiveness. The principles employed to achieve semi-active control is to adjust the flow through the horizontal channel by valves. Thus, the range of adjustment is very limited but is adequate for ship roll control..

Passive control devices are tuned to particular frequencies. A passive control device is thus only effective if the forcing frequency is close to the device's tuned frequency. Excitations that affect large civil structures are often multi-frequency forces. For example, seismic excitations have energies spread over a band of frequencies. When the excitation is a multi-frequency force, passive control devices are much less effective. Active control devices are needed to improve damping effectiveness against multi-frequency excitation forces. Several active structural control devices have been developed and installed. These active devices include active tendon systems and active mass dampers.

Active mass dampers are usually installed on the top floor of a tall building. They have a solid mass of several hundred tons (at least one percent of the building mass). The motion of this mass is regulated by hydraulic actuators during an earthquake so that the building motion can be reduced. The effectiveness of control devices can be improved by the addition of such active control. However, current active mass damper systems have many drawbacks. For example, these systems have an excessive peak power requirement. There are also reliability problems inherent with infrequently used equipment.

Tuned liquid dampers are similar to tuned mass dampers. Tuned liquid dampers utilize a large mass of liquid. As discussed above, tuned liquid dampers are only effective when the forcing frequency is near the natural frequency of the system. Tuned liquid dampers could be, made responsive to different forcing frequencies by utilizing active control. However, if the conventional active control concept were used, for example, to regulate the motion of the tank, peak power requirements and reliability problems would again be the severe limitations.

It is an object of the invention to provide active control of a tuned liquid damper system with a minimum power requirement.

It is another object of the invention to provide an actively tuned liquid damper system that is simple to construct and has relatively low cost in relation to previous structural motion control systems.

It is another object of the invention to provide an actively tuned liquid damper system that may be easily adjusted or altered during or after installation.

It is a further object of the invention to provide an actively tuned liquid damper system with multiple degrees of freedom.

It is a further object of the invention to provide an actively tuned liquid damper system that may be regularly tested without imparting motion to the structure to which the system is attached.

SUMMARY OF THE INVENTION

An actively tuned liquid damper is provided that utilizes liquid as a damper for structural control. The actively tuned liquid damper has a container or tank which retains a liquid mass, similar to a passive tuned liquid damper. The tank is attached to the structure whose motion is to be damped. Active control of the damper's response frequencies is accomplished through active tuning of the length of the liquid compartment or the liquid depth. Tuning of the damper is achieved by controlling a rotatable baffle to regulate the effective length of the tank. The tank's effective length dictates the natural frequency of the liquid, and thus the response frequency of the damper. Additional control of the actively tuned liquid damper may be achieved by utilizing combinations of multiple baffles in a tank and through the use of multiple tanks.

As a general guideline, a motion damping system should have a mass of at least 1% of the structure to which it is attached and an optimum damping coefficient of about 5%. Thus, the liquid mass for the actively tuned liquid damper should utilize a liquid mass of at least 1% of the structure mass. However, when a tank is deeply filled with a liquid, only the liquid in the surface layer sloshes as the tank moves.

Thus, most of the liquid in the tank does not contribute to the damping action. Accordingly, shallow-filled tanks are more efficient for structural control. An actively tuned liquid damper should thus consist of many tank groups each containing ten to twenty shallow tanks stacked on top of each other.

High winds and earthquakes will usually induce structural motion predominantly in the structure's fundamental mode. Accordingly, the basic component of the actively tuned liquid damper is a liquid damper tuned to the structure's fundamental frequency. Although liquid sloshing is a highly nonlinear phenomenon, the frequencies of sloshing can be approximated by the following equation which is based on a linear theory:

$$\omega_n^2 = g\frac{n\pi}{2a}\tanh\left(\frac{n\pi D}{2a}\right)$$

where $\omega_n$ is the $n^{th}$ natural frequency of the liquid in radians/second, $2a$ the tank length, D the fill depth, n the mode number, and g the acceleration due to gravity. Distances $2a$ and D, and acceleration g are measured in meters and meters/second/second, respectively, or in any other consistent units.

When a tuned liquid damper is excited at its fundamental frequency, a large slosh force will be produced. This force is 90 degrees out of phase with the structural motion and thus contributes to damping the structure's motion. At higher excitation frequencies, however, liquid motion will be in higher modes. Although these higher modes also produce significant slosh forces, experimental results indicate that these forces will not be sufficiently out of phase with structural motions. Therefore, the higher mode slosh forces do not contribute much to damping the structure's motion.

The equation above shows that the liquid's natural frequency is proportional to the liquid fill depth but is inversely proportional to tank length. Therefore, tuning of the liquid can be achieved by either adjusting the fill depth or the effective tank length. The effective tank length can be adjusted by controlling the orientation of one or more baffles. When the baffles are parallel to the tank's longitudinal axis, the tank is at its full length and is effective at the designed fundamental frequency. When the baffles are perpendicular to the tank's longitudinal axis, the tank is effectively divided into two or more shorter tanks, each with a higher fundamental frequency. Thus:, the tuned liquid damper becomes effective at higher frequencies. When the baffles are in an in-between orientation, the resonance frequency will be between the endpoint frequencies produced by placing the baffles either parallel or perpendicular to the tank's longitudinal axis. Therefore, by controlling the orientation of the baffles, the tuned liquid damper become,,; effective over a range of frequencies.

The actively tuned liquid damper eliminates the need to regulate the motion of the tank in order to achieve active control. Thus, it requires a very small amount of power and is more reliable as compared with other active control devices such as active mass dampers. When there is no external excitation, the baffles' positions may be freely adjusted without imparting motion to the building. Therefore, the baffle position control systems may be regularly tested without discomfort to a structure's occupants.

Further objects and features of the invention will be apparent to those skilled in the art from the following detailed description of preferred embodiments, taken together with the accompanying drawings.

DETAILED DESCRIPTION OF THE PREFERRED EMBODIMENT

Figure 1A:
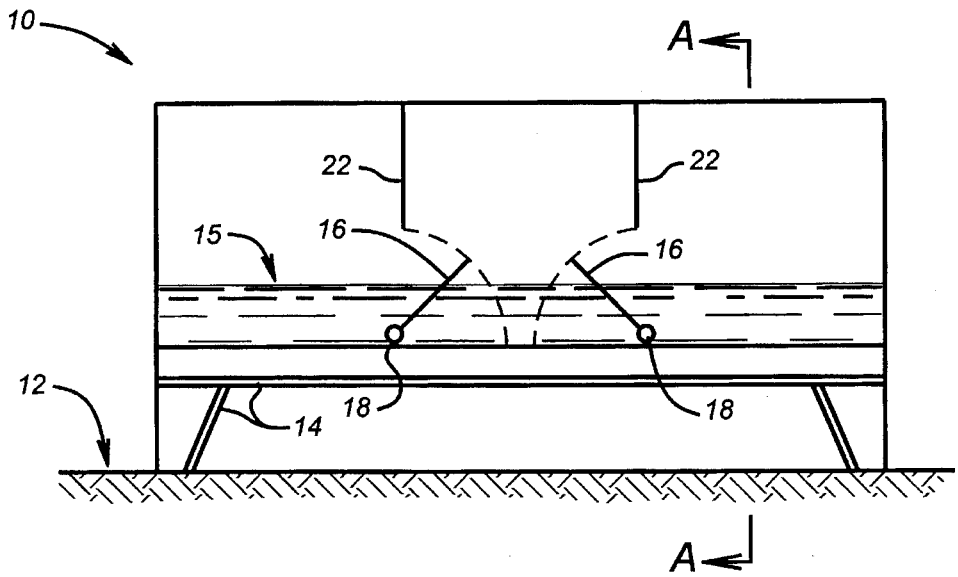
FIG. 1A shows a longitudinal cross section of the device.
Figure 1B:
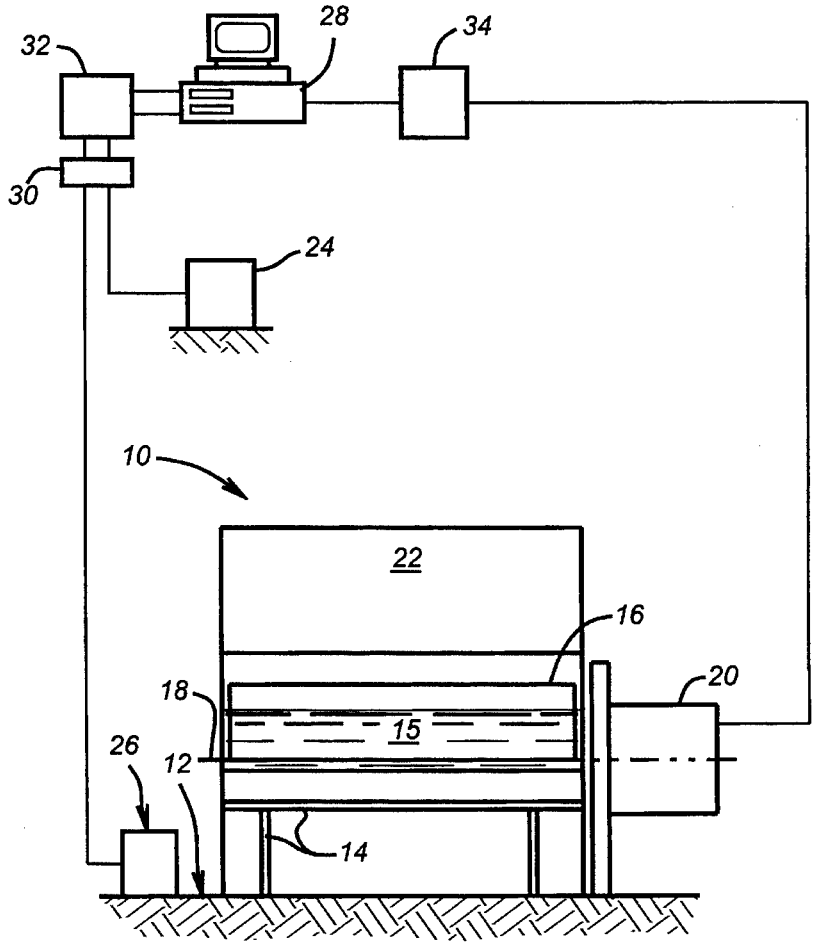
FIG. 1B shows a transverse cross section of the device through section A—A of FIG. 1A.

Referring to FIGS. 1A–B, one embodiment of the actively tuned liquid damper is shown. A tank 10 is mounted to the top of a structure, such as a building 12. Supports 14 are used to insure adequate support of the weight of the tank 10 and the liquid 15. In the preferred embodiment, the ratio of the liquid depth to the length of the tank is at least 0.08:1, but generally should not be more than 0.15:1. The container height should be at least twice the liquid depth to preclude impairment of the damper's effectiveness. Transverse baffles 16 are rotatably mounted to the tank 10 so that they rotate about axes 18. In the preferred embodiment, multiple baffles 16 are used to increase the range of frequencies to which the tank 10 can be tuned. The rotational position of each baffle 16 is controlled by an externally mounted stepping motor 20. In the preferred embodiment, fixed baffles 22 are transversely mounted in the tank 10 so that, when the rotatable baffles 16 are rotated into a vertical position, the tank 10 is completely subdivided into chambers which are not in fluid communication with each other. A further feature of the preferred embodiment is that multiple tanks 10 are used so that each tank 10 contains a fraction of the total liquid mass. The tanks 10 may be mounted on top of each other or in any other manner which fits the available space. Stacks of ten to twenty tanks 10 are preferred.

In the preferred embodiment, measurements of the ground's motion are made by ground motion sensors 24. The structure's motion is measured by building motion sensors 26. Motion sensors suitable for this purpose are Model 8306 Low Frequency Accelerometers manufactured by B&K Instruments, Inc., 5111 W. 164th Street, Cleveland, Ohio 44142. Signals from the ground and building motion sensors 24, and 26 are analyzed and compared using a microcomputer 28. In the preferred embodiment, a time-varying, moving-window Fourier analysis is used to determine the time-frequency distribution of the signals. Because analysis speed is critical in providing sufficiently rapid control of the actively tuned liquid damper, the computer 28 must have sufficient capacity and speed to facilitate this real-time control. One computer possessing the requisite capabilities is the 486DX266 PC, manufactured by Dell Computer Corp., 9505 Arboretum Blvd., Austin, Tex., utilizing the following additional equipment: a standard signal conditioning/amplifier unit 30, a DAS 20 analog-to-digital converter board 32, and an RTI-815 digital-to-analog converter board 34.

The determination of how to position the baffles 16 is made as follows: Low frequency accelerometers 24 measure ground motion. Additional low frequency accelerometers 26 measure structure responses. Placement of accelerometers 24 and 26 is determined by the building site and the mode shapes of the structure. The "mode shapes" of the structure are determined by how the structure moves when exited by a particular vibrational mode. In general, the accelerometers 26 should not be place at nodes, that is, at locations where the structure will not move. The output of accelerometers 24 and 26 are processed through a signal conditioning/amplifier unit 30. The signal conditioning/amplifier unit 30 removes unwanted high frequency noise, preferably eliminating frequencies above 20 Hertz. The conditioned signal is then amplified by the signal conditioning/amplifier unit 30. The output of the signal conditioning/amplifier unit 30 is converted to a digital signal by an analog-to-digital converter 32. The analog-to-digital converter 32 is preferably installed in the processing microcomputer 28.

At least two alternate methods of analyzing the digital signals output by the analog-to-digital converter 32. The preferred method is accomplished by frequency analysis of the ground motion and the building response. This analysis utilizes either the time-varying moving-window Fourier analysis technique described in the paper by W. Chen, N. Keltarnowaz, and T. W. Spancer, "An Efficient Recursive Algorithm for Time-Varying Fourier Transform," IEEE Trans. Signal Processing, Vol. 41, No. 7, July 1993, pp. 2488–2490, or the wavelet method described in the book by C. K. Chui, "An Introduction to Wavelets," Academic Press, 1992. The time-varying moving window Fourier analysis allows determination of the frequency-time distribution of the building response. The analysis also provides information on the energy concentrations at each frequency range. Both the time-varying moving window Fourier analysis and the wavelet method are well developed and offer rapid data analyses sufficient to meet the real-time requirements of this invention. Computer software based on these methods is readily available, for example, the wavelet software is available in the software package "MATLAB" and the time-frequency analysis software is available in the "Gabor Spectrogram" software package by National Instruments, Inc. The second method of analyzing the digital signals output by the analog-to-digital converter 32 is to determine the modal participation factors of the building response. Because wind and earthquake excitations are basically low frequency phenomena, building response will be predominantly in the first two or three modes. Modal analysis techniques are well developed and have been widely used by structure engineers. For example, see "Dynamics of Structures" by Hurty and Rubenstein, Prentice-Hall, 1964. Because only a few modes need to be analyzed, signal processing can be performed quickly enough to meet real time control constraints.

If the structure's 12 response is primarily in the structure's 12 fundamental mode, no active control is necessary and the baffles 16 will remain in the lay down position. However, if the building response involves higher modes, the liquid tanks 10 can be controlled in groups. Each group is used to damp the structure's 12 response at a particular frequency. The number of tanks 10 in each group will depend on the relative intensity of the, energy level associated with the target frequency. The orientation of the baffles 16 in each group will depend on the targeted frequency for that group. The baffles 16 may have to be rotated to a vertical position to completely divide the tank 10 into several short compartments, or the baffles 16 may be rotated into an inclining position.

The microcomputer 28 generates a digital control signal to position the stepping motor 20. This digital signal is convened to an analog signal via an digital-to-analog converter 34. The resulting analog signal drives the stepping motor 20. The stepping motor 20 rotates the baffle 16 into the desired positions.

Many modifications and variations may be made in the embodiments described herein and depicted in the accompanying drawings without departing from the concept of the present invention. Accordingly, it is understood that the embodiments described and illustrated herein are illustrative only and are not intended as a limitation upon the scope of this invention.

I claim:

1. An actively tuned liquid damper for a structure comprising:

at least one container for containing a liquid mass; means for attaching said container to a structure; and at least one internal barrier rotatably moveable with respect to the longitudinal axis of said container to selectively subdivide said container; and means for selectively moving said barrier in order to selectively subdivide said container.

2. The actively tuned liquid damper of claim 1, wherein said internal barrier comprises at least one baffle.

3. The actively tuned liquid damper of claim 2, wherein said baffle is rotatably attached to said means for containing a liquid mass.

4. The actively tuned liquid damper of claim 1, wherein said means for selectively moving said barrier length additionally comprises at least one stepping motor.

5. The actively tuned liquid damper of claim 1, wherein said barriers are positionable so that said container is divided into chambers such that said chambers are not in fluid communication.

6. The actively tuned liquid damper of claim 1, wherein at least two containers are attached to the structure such that the longitudinal axes of said containers are parallel to each other.

7. The actively tuned liquid damper of claim 1, wherein at least two containers are attached to the structure such that the longitudinal axes of said containers are orthogonal to each other.

8. A method of damping a variety of frequency inputs to a structure comprising:

mounting at least one partially filled liquid container on the structure;

sensing the input frequency of an excitation to the structure; and actively varying the effective length of said container so that at least one natural frequency of the contained liquid approximates the input frequency of the excitation and so that the motion of the liquid is out of phase with the excitation.

9. The method of claim 8 further comprising the step of:

moving at least one baffle in the container.

10. The method of claim 9 further comprising the step of:

using a stepping motor to adjust the baffle.

11. The method of claim 8 further comprising the step of:

isolating at least two compartments within the container so that said compartments are not in fluid communication.

12. The method of claim 8 further comprising the step of:

mounting a plurality of containers to the structure.

13. The method of claim 8 further comprising the step of:

maintaining a ratio of liquid depth to container length of at least 0.08:1 when there is no excitation to the structure and the effective length of the container is the actual length of the container.

14. The method of claim 8 further comprising the step of:

maintaining a ratio of liquid depth to container length of at most 0.1:5:1 when there is no excitation to the structure and the effective length of the container is the actual length of the container.

15. The method of claim 8 further comprising the steps of:

actively determining the desired effective length of said container by computation; and generating a signal to control the effective length of said container.

16. The method of claim 15 further comprising the step of:

using at least one microprocessor to actively compute the desired effective length of said container and to generate said signal to control the effective length of said container.

* * * * *